United States Patent [19]

Emery et al.

[11] Patent Number: 4,480,781

[45] Date of Patent: Nov. 6, 1984

[54] MOULDED EGG CARTON WITH FINGERS FOR SUPPORTING THE EGG

[76] Inventors: Roy W. Emery, 1 Donino Ct., Toronto, Ontario, Canada, M4N 2H6; John R. Emery, 83 Ames Cir., Don Mills, Ontario, Canada, M4N 2M8

[21] Appl. No.: 475,758

[22] Filed: Mar. 16, 1983

[51] Int. Cl.[3] ..... B65D 85/32

[52] U.S. Cl. ..... 229/2.5 EC; 206/45.14; 229/44 EC

[58] Field of Search ..... 229/2.5 EC, 45 EC, 44 EC, 229/29 M; 206/45.14, 45.15; 217/26.5

[56] References Cited

U.S. PATENT DOCUMENTS

| | | | |
|---|---|---|---|
| 2,764,334 | 9/1956 | Schwertfeger | 229/2.5 EC X |
| 3,327,918 | 6/1967 | White | 229/29 M X |
| 3,362,605 | 1/1968 | Bixler | 229/2.5 EC |
| 3,920,178 | 11/1975 | Moller | 229/2.5 EC |
| 4,059,219 | 11/1977 | Reifers et al. | 229/2.5 EC |
| 4,193,531 | 3/1980 | Saby | 229/2.5 EC |

FOREIGN PATENT DOCUMENTS

| | | | |
|---|---|---|---|
| 2367682 | 6/1978 | France | 229/2.5 EC |

*Primary Examiner*—William Price
*Assistant Examiner*—Gary E. Elkins
*Attorney, Agent, or Firm*—Fetherstonhaugh & Co.

[57] ABSTRACT

The invention relates to a moulded container of the type commonly made from wood pulp fiber and used for packaging eggs. The container has a cover with an opening through which eggs contained in cells in the tray portion can be viewed. The cells are partially defined by a series of posts and the cover has a rib that engages with the tops of the posts. The viewing opening is on either side of the rib and there is provision in the cover for resilient fingers that extend downwardly and outwardly of the rib and into the cell to engage with an egg to stabilize it in its respective cell.

2 Claims, 4 Drawing Figures

MOULDED EGG CARTON WITH FINGERS FOR SUPPORTING THE EGG

This invention relates to a moulded container of the type commonly used for eggs. These containers are moulded from a cellular material such as wood pulp or a foamed plastic. They have a tray with a series of upwardly extending posts that divide the tray into a series of cells on each side of the posts and a cover that can be locked in the closed position to form a strong container for frangible articles such as eggs.

The common configuration for such a container is one that will hold one dozen eggs and that has a hinged cover and a locking flap and a signle series of upwardly extending posts that divide the tray into two series of six cells on each side of the posts. However, the container is not limited to such a configuration. There could be more than one series of posts and the cover could be separately formed from the tray.

It is desirable in such a container to provide a window opening in the cover so that the eggs in the individual cells can be viewed by the purchaser without opening the container and containers of this characteristic are well known. U.S. Pat. No. 4,059,219 dated Nov. 22, 1977 for an invention entitled "Egg Carton" to Richard F. Reifers et al is an example of such a container.

Breakage of frangible articles such as eggs is always a problem. The individual cells of these containers are moulded to give optimum support to the average egg shape in a particular size range. All eggs of a given weight range, however, are not of the same shape and it quite often happens that an egg will have considerable play in its packing cell in such a container. Breakage often results. Breakage of eggs in the marketing of eggs is a long standing and costly problem to retailers.

This invention represents a substantial improvement in the configuration of a container of the general type to which the invention relates in that it provides a firm support for eggs irrespective of their shape and in an extended range of weight. It achieves this by the provision of a resilient finger that extends into the cells and supports the eggs by providing a restraint against lateral movement of the eggs.

A moulded egg carton according to the invention comprises a tray, a cover wherein the tray has a series of upwardly extending posts that partially divides the tray into a series of cells on each side of the series of posts the improvement of a cover configuration that has a stabilizing rib that sits on the top of the posts of said series of posts when the cover overlies the tray; a series of window openings in said cover on each side of said rib to expose to view the cells of each of said series of cells; resilient finger means extending downwardly and outwardly of the rib into each cell of each of said series of cells to overlie an article in the cell in use; said resilient finger having a length to engage with an egg in its respective cell to provide support for an article in said cell when the cover is closed on the tray in use. The invention will be clearly understood after reference to the following detailed specification ready in conjunction with the drawings.

Figure 4:
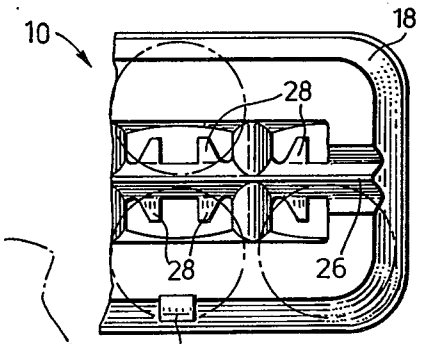
FIG. 4 is a partial plan view of a closed container showing eggs in place in phantom outline.
Figure 1:
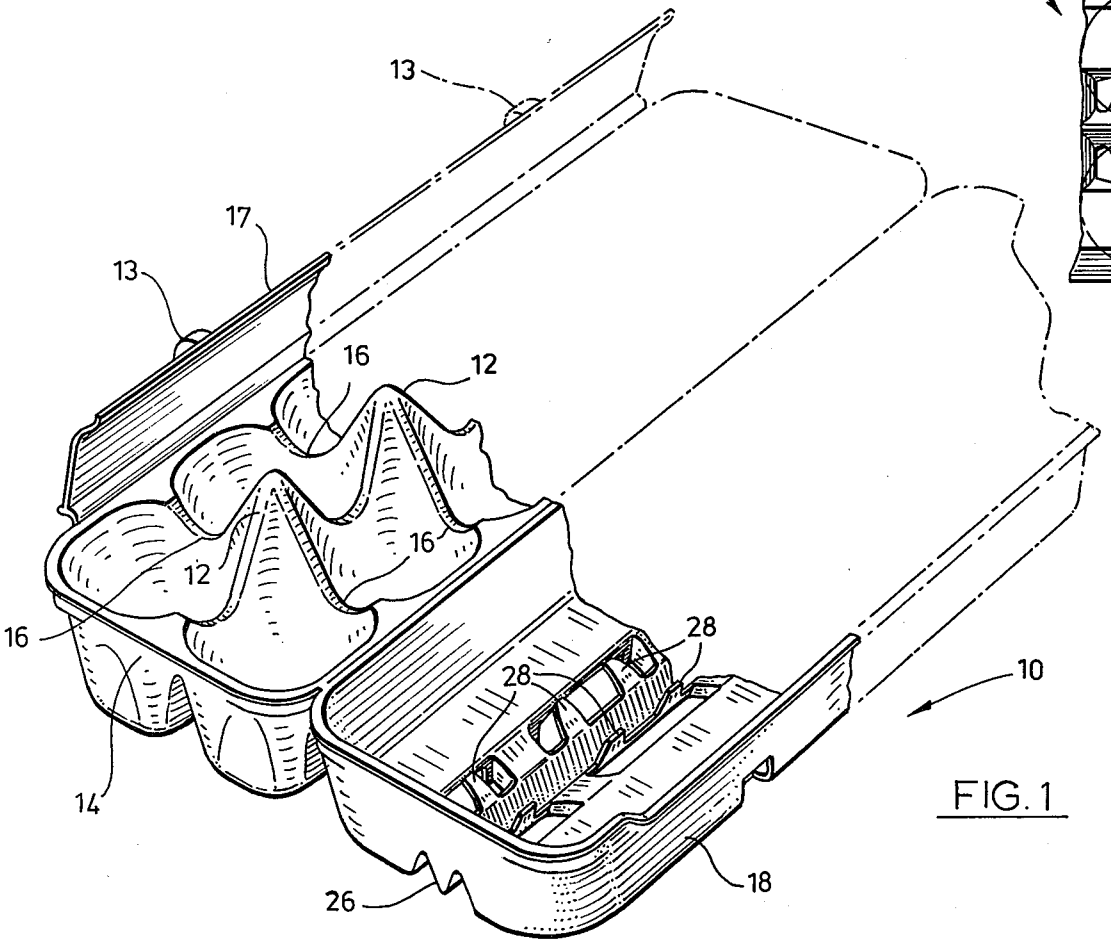
FIG. 1 is an illustration of an egg container according to the invention with a portion of it being in phantom line, it being understood that the portion in phantom line is a repetition of the portion in solid line.

The numeral 10 generally refers to a moulded egg carton according to this invention. The carton illustrated is designed to package one dozen eggs arranged in two series of egg retaining cells, one on each side of a series of posts 12 in the tray portion 14 of the container. The cells are partially defined by the posts 12 and partially by the side walls of the tray 14 and the cross dividers 16 which merge with the posts. A locking strip 17 is hinged to the tray 14 and has locking knubs 13 which engage in holes in the flange of the cover 18 to perform the locking function as is well known in the art. The edges of the tray 14 and of the cover 18 each have a horizontally extending edge flange that close upon each other to give rigidity to the construction. The top cover normallly has a configuration that rests upon the upper extremities of the series of posts to give further strengthening of the structure when it is closed in use.

These containers carry substantial weight when loaded with a dozen eggs and they are constructed of light materials. The reinforcing features just referred to are common and are not, generally speaking, part of this invention.

Figure 2:
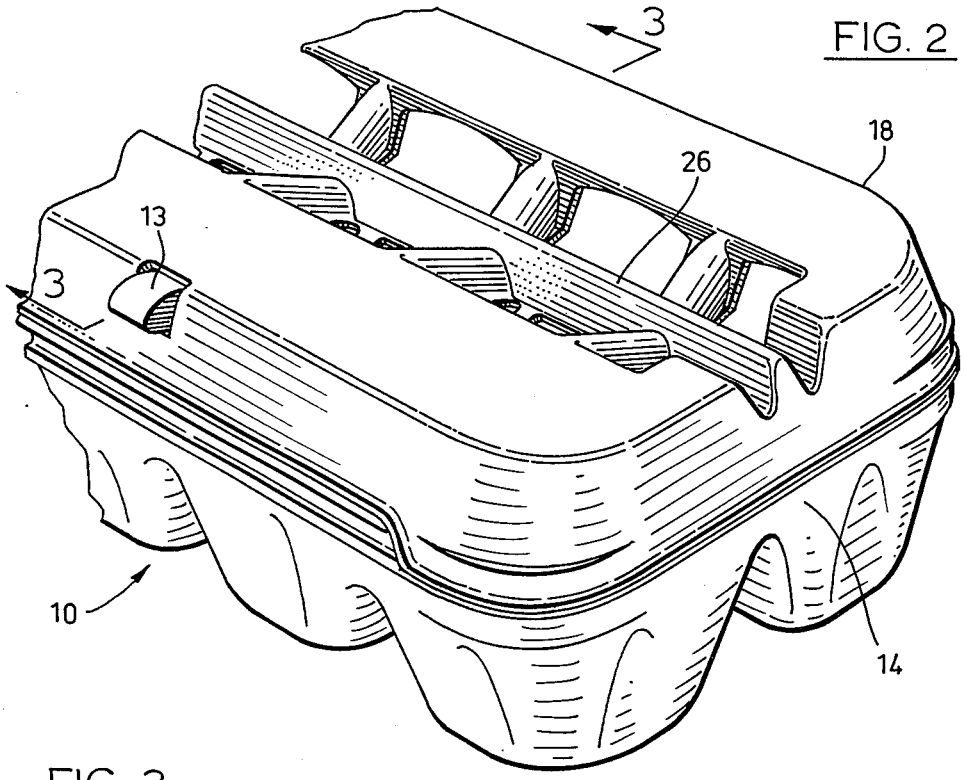
FIG. 2 is an illustration of one end only of the container of FIG. 1 with the top cover closed over the tray portion.
Figure 3:
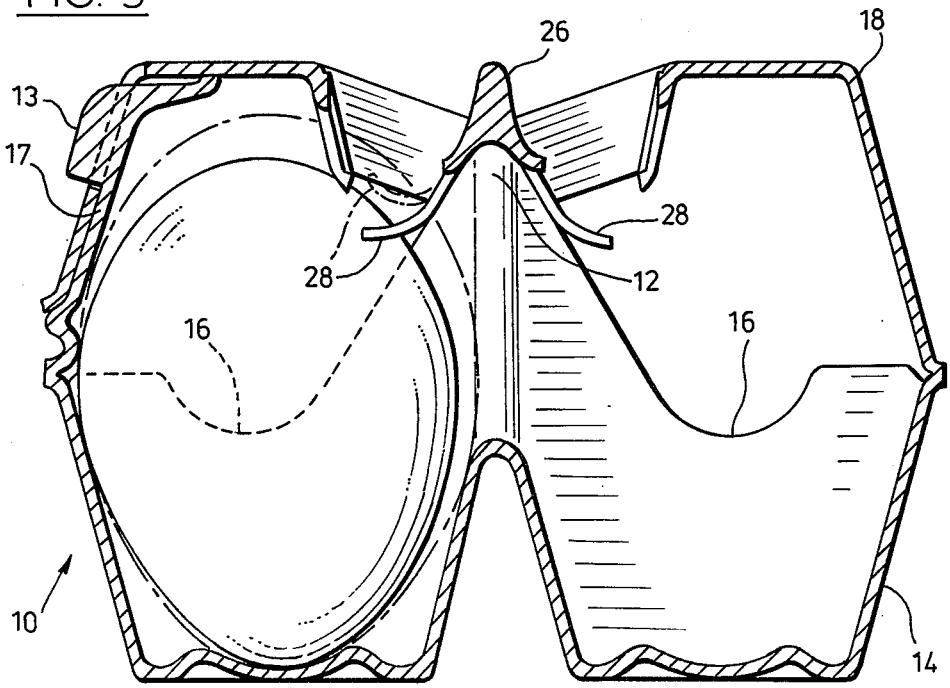
FIG. 3 is a sectional view along the line 3—3 of FIG. 2.

This invention is, as noted in the preamble, concerned with a special configuration for the lid or cover 18. The cover 18 is formed with a longitudinally extending rib 26 that is long enough to engage upon and rest upon the top of each of the series of posts 12 when the cover is closed as illustrated in FIGS. 2 and 3. The provision of a rib that extends longitudinally of a cover in this way and that engages the upper extremities of the series of posts is not, of itself, new. This invention is concerned with resilient fingers that extend downwardly, and outwardly of the rib 26 into the cells to engage with the eggs in the cells and provide support for the eggs when the cover is closed on the tray in use.

The form of resilient fingers illustrated in the embodiment of the invention as shown in the drawings comprises fingers 28 which are adapted to extend downwardly into each cell when the cover is closed as illustrated in FIG. 3. There are two fingers per cell except for the corner cells. One of the two fingers 28 engages the egg on one side of its centre and the other of the fingers engages the egg on the other side of its centre so that the egg is restrained from movement in its cell both vertically and laterally. In the case of the corner cells there is only one finger but the egg is additionally restrained in the corner.

FIG. 3 shows a cell with two outlines of an egg, one in solid line and the other in broken line. The fingers 28 are illustrated in each case as being in engagement with and supportive of the egg of each size.

It is not intended that the invention should be restricted to the form of the resilient finger configuration illustrated. Even a single finger at the center of the egg would be of use.

The fingers 28 are integrally moulded with the container and they are of the same material as the container. A common material for these containers is moulded wood pulp fibre. It is firm enough to give the support but resilient enough to conform to the egg size as the cover is closed. A further common material is moulded foam plastic.

It will be appreciated that the drawings illustrate a container having two rows of egg containing cells with six cells in each row. Containers having other row configurations are possible. Further, the invention could be used on containers with removeable covers. For example, a popular configuration is three rows of four cells each. Moreover, the container could be used for frangible articles other than eggs.

The fingers exert a hold-down force on the eggs so that looseness of the egg in its cell because of irregular shape within a commercial weight or size range is reduced or eliminated. For example, "large" eggs are all of a given weight range but their shape varies with the result that unusually shaped eggs of a given weight are not well supported in a conventional cell. This invention overcomes the problem by providing a hold-down force for all eggs including the irregularly shaped ones. Moreover, it is practical to use one size container for more than one size of egg. It is normal to provide a different size container for large and small eggs. With this invention and the hold-down force the large container could support both size eggs. This reduces stocking problems for the egg producer.

An embodiment of the invention in which an exclusive property or privilege is claimed and defined as follows:

1. A moulded carton comprises:

a tray;

a hinged cover for the tray;

the tray having a series of upwardly extending posts that partially divides the tray into a series of cells on each side of the series of posts the improvement of a cover configuration that has a stabilizing rib that sits on the top of the posts of said series of posts when the cover overlies the tray;

a series of window openings in said cover on each side of said rib to expose to view the cells of each of said series of cells;

resilient finger means integrally moulded to extend downwardly and outwardly of the rib into each cell of each of said series of cells to overlie an article in the cell in use;

said resilient finger means having a length to engage with an egg in its respective cell to provide support for an article in said cell when the cover is closed on the tray in use;

said resilient finger means comprising at least two fingers, one on each side of the vertically extending centre of the cell whereby to provide vertical and lateral support to an egg in said cell when the cover is closed on the tray in use.

2. An integrally moulded egg carton as claimed in claim 1 in which the material of said carton is moulded wood pulp fiber.

* * * * *